US007251863B2

(12) United States Patent
Leinders

(10) Patent No.: US 7,251,863 B2
(45) Date of Patent: Aug. 7, 2007

(54) DRAW FRAME FOR TEXTILE FIBRE SLIVERS HAVING A DRAWING SYSTEM WITH TOP ROLLERS THAT CAN BE LOADED AND RELIEVED OF LOAD

(75) Inventor: Christoph Leinders, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 432 days.

(21) Appl. No.: 10/890,326

(22) Filed: Jul. 14, 2004

(65) Prior Publication Data

US 2005/0011052 A1 Jan. 20, 2005

(30) Foreign Application Priority Data

Jul. 14, 2003 (DE) ..... 103 31 759

(51) Int. Cl.
*D01H 5/00* (2006.01)

(52) U.S. Cl. ..... 19/236

(58) Field of Classification Search ..... 19/258, 19/266–285

See application file for complete search history.

(56) References Cited

U.S. PATENT DOCUMENTS 5,799,374 A * 9/1998 Strobel et al. ..... 19/274
5,953,793 A * 9/1999 Roder ..... 19/266
6,134,752 A * 10/2000 Gohler et al. ..... 19/272
7,076,841 B2 * 7/2006 Moller et al. ..... 19/266

FOREIGN PATENT DOCUMENTS

| | | |
|---|---|---|
| DE | 1 225 528 B | 5/1960 |
| DE | 1 660 414 B | 5/1965 |
| DE | 2 018 593 A | 4/1970 |
| DE | 16 60 414 A1 | 4/1972 |
| DE | 195 48 840 A1 | 7/1997 |
| DE | 198 39 885 A1 | 3/2000 |

* cited by examiner

*Primary Examiner*—Shaun R. Hurley
(74) *Attorney, Agent, or Firm*—Venable LLP; Robert Kinberg; Ryan M. Flandro

(57) ABSTRACT

A draw frame for textile fiber slivers has a drawing system of successively arranged assemblies of rollers comprising a bottom and a top roller, in which, during operation, the top rollers are pressed against the bottom rollers by weighted pressing devices. When operation is suspended, the bearings of the top rollers are relieved of the weighting by the pressing devices. On interruption to continuous operation the top output roller or the top output rollers is/are capable of being relieved of loading in such a way that no or only slight pressure is exerted on the fiber slivers. To avoid or reduce undesirable formation of windings in a simple manner, resiliently loaded elements that lift the top roller bearings after the pressing devices have been relieved of loading are associated with the bearings of at least one top roller.

22 Claims, 7 Drawing Sheets

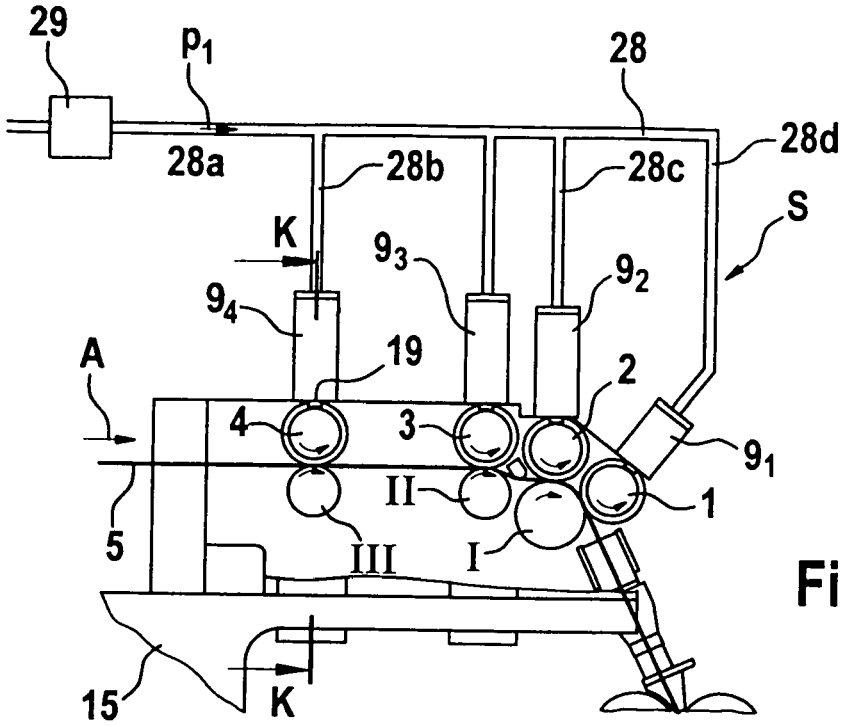
Fig. 1
Fig. 2
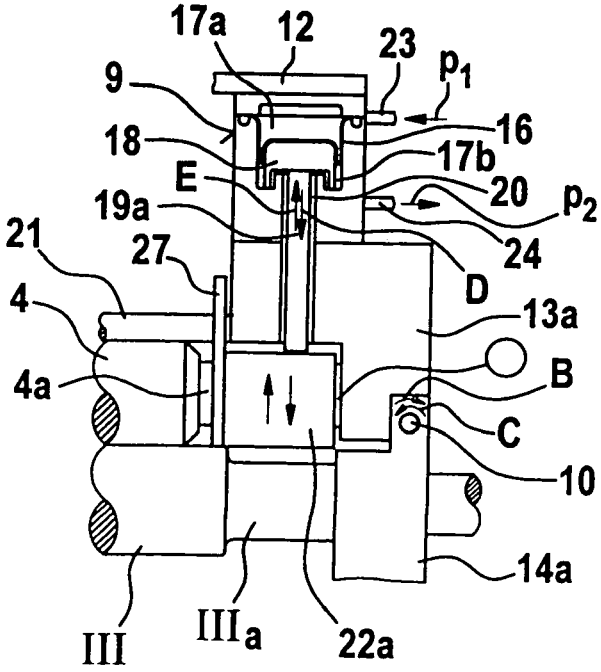

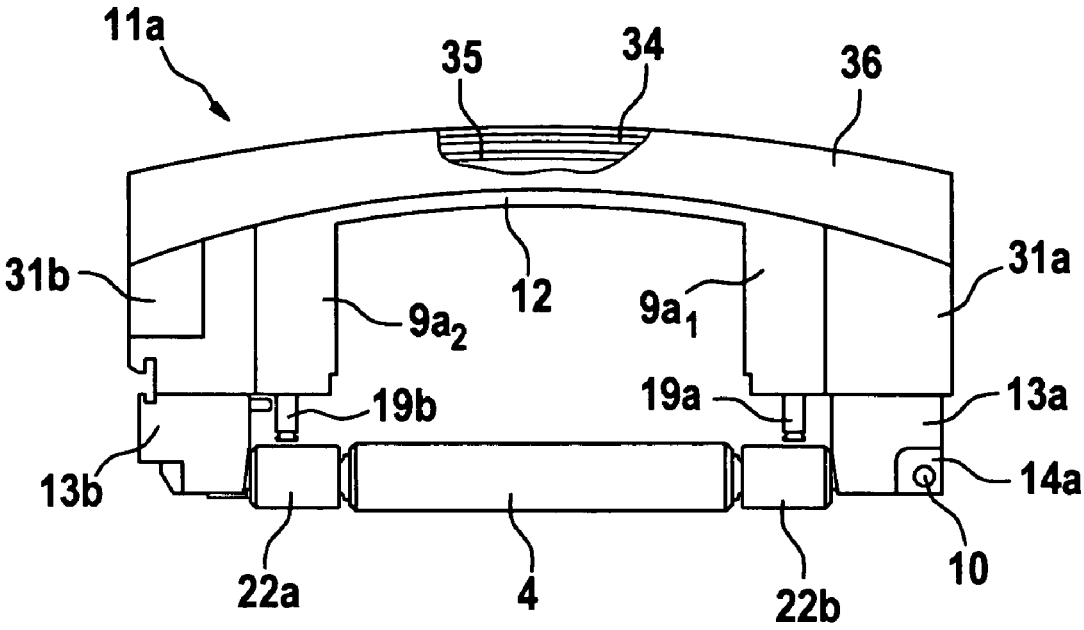
Fig. 3
Fig. 3a
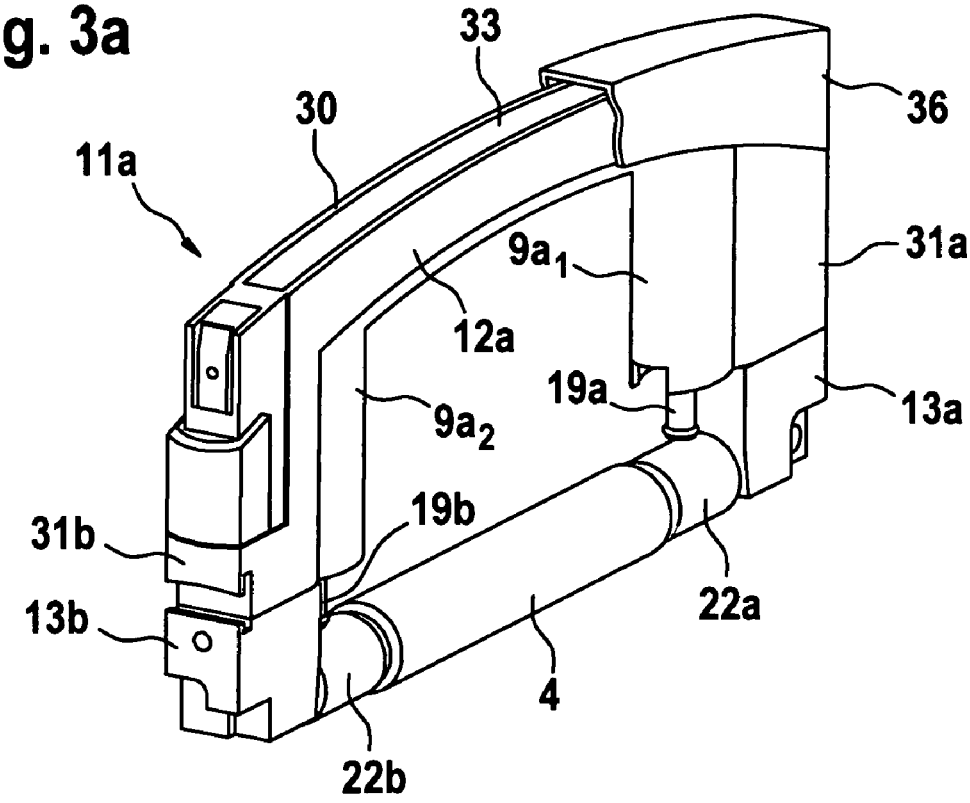

DRAW FRAME FOR TEXTILE FIBRE SLIVERS HAVING A DRAWING SYSTEM WITH TOP ROLLERS THAT CAN BE LOADED AND RELIEVED OF LOAD

CROSS REFERENCE TO RELATED APPLICATION

This application claims the priority of German Patent Application No. 103 31 759 dated 14 Jul. 2003, the disclosure of which is incorporated herein by reference.

BACKGROUND OF THE INVENTION

The invention relates to an apparatus on a draw frame for textile fibre slivers with a drawing system of successively arranged pairs of rollers comprising a bottom and a top roller in which a load can be applied to the top rollers.

During operation of a draw frame of the above-mentioned kind, the top rollers are pressed against the bottom rollers by weighted pressing elements in pressing arms. When operation is suspended, the bearings of the top rollers are relieved of the loading by the pressing arms and upon interruption to continuous operation the top output roller or the top output rollers are relieved of loading such that no or only slight pressure is exerted on the fibre slivers.

During operation, the pressing arms are closed and the pressing devices press the top rollers onto the associated lower rollers of the drawing system. When operation of the drawing frame is suspended, particularly for a longer time period, the pressure cylinders and hence at the same time the top rollers are relieved of load, so that the rollers (roundness) and their resilient coating are protected against deformation. When the pressing arms are pivoted open while the top rollers remain stationary on the lower rollers, the top rollers exert a pressure on the bottom rollers by virtue of gravity. Since the slivers are positioned between the top and bottom rollers, the top rollers, in their idle state, exert a pressure on the slivers. During operation, particularly at high sliver speeds of 1,000 m/min and above, the rollers heat up substantially. The fibres frequently contain substances that become sticky when heated, for example, honeydew in the case of cotton and lubricating agents in the case of synthetic fibres. When the draw frame is at a standstill for a relatively long period—especially for longer than the time required to exchange full for empty cans at the output end of the draw frame—for example, on sliver rupture, when exchanging empty for full cans at the input end of the draw frame, during operational disturbances and the like, the top output roller(s) in particular, at the roller nip with the bottom output rollers, press against the substances clinging to the fibres and the substances become sticky owing to the heat. The disadvantage of this is that the slivers stick firmly especially to the top roller or top rollers and, when operation resumes, are entrained by the rotating roller and wind undesirably around the roller. This causes considerable disturbance to operation, since the drawing system is immediately stopped and the wrapped-round sliver has to be manually removed. In particular, the incident can often not be immediately resolved, which leads to delays and thus to production losses.

In a known apparatus (DE 198 39 885 A1), at least one separately controllable pneumatic valve for the pneumatic cylinder is associated with the top output roller and/or the top output rollers and at least one adjustable carrier lever or similar for the top output roller is associated with the pneumatic cylinder. By pulling in the ram, the carrier lever is drawn up and with it, the associated top roller bearing. In order to realise two loading functions of the pressure cylinder, that is, a push function and a pull function, a complicated valve device with corresponding valve control (separately controllable pneumatic valve) is required.

It is an aim of the invention further to improve an apparatus of the kind described in the introduction, and to provide a draw frame which avoids or mitigates the said disadvantages and in which in particular the undesirable formation of windings is avoided or reduced.

SUMMARY OF THE INVENTION

The invention provides a draw frame for textile fibre slivers having a drawing system comprising:

a first roller assembly and a second roller assembly, said first and second roller assemblies being arranged one after the other and each comprising a bottom roller and a top roller having first and second top roller bearings;

a loading arrangement for applying a load to said top rollers so as to press said top rollers against said respective bottom rollers, which load can be substantially relieved by the loading arrangement; and a lifting arrangement for lifting a said top roller from a said bottom roller when said load is substantially relieved.

Advantageously, the lifting arrangement comprises:

a first resiliently loaded element associated with a first top roller bearing of a said top roller;

a second resiliently loaded element associated with a second top roller bearing of that roller;

said first and second resiliently loaded elements being arranged for lifting said first and second top roller bearings when the load applied by the loading arrangement is substantially relieved.

Advantageously, the lifting arrangement comprises first and second resilient loading elements for loading said first and second resiliently loaded elements.

When operation is interrupted, the bearing pressure of the top rollers on the fibre slivers is absent or substantially absent and, in particular, the top roller engages only slightly or not at all with the fibre material, so that heating of substances in the fibre material, and thus the adhesive effect, are avoided. The fibre slivers are thus effectively prevented from undesirably adhering to the rollers, so that entrainment upon re-start and hence the formation of a winding around the rollers does not occur. Because a resilient element, preferably a mechanical compression spring, is provided to lift the top roller bearing, a substantial structural simplification is achieved. Unlike the known apparatus, a separately controllable valve control for lifting the top roller is not present. A particular advantage is the fact that each time the top roller bearings are relieved of the pressure exerted by, for example, a pneumatic ram (that is, the pressure is reduced or removed), the resilient element automatically relaxes, and as a result, the top roller bearings are lifted from the bottom roller bearings including the top rollers from the bottom rollers.

Advantageously, at least one said resiliently loaded element is a driver element. At least one said loaded element is advantageously loaded by a spring, for example, a compression spring. Advantageously, as driver element an angle lever, angled plate or the like is provided. Advantageously, one angle arm of the driver element engages beneath the top roller bearing or the bearing stub. Advantageously, the free end of a resilient element, for example, compression spring, loads the driver element. Advantageously, a resilient element, for example, compression spring, is supported on a fixed bearing. Advantageously, the line of action of the ram and the line of action of at least one resilient element, for example, compression spring, run substantially axially parallel to one another. Advantageously, at least one resilient element, for example, compression spring, is tensioned in continuous operation. Advantageously, each time the pressing elements are relieved of loading, a said resilient element, for example, compression spring, relaxes. Advantageously, the relaxation of the resilient element, for example, compression spring, is effected automatically. Advantageously, lifting of the top roller bearings or the bearing stubs is effected upon extended interruption of continuous operation. Advantageously, lifting of the top roller bearings or the bearing stubs is effected within a short time. Advantageously, upon continuation of continuous operation, the loading of the top rollers and the tensioning of the resilient elements, for example, compression springs, are effected automatically. Advantageously, upon continuation of continuous operation, the loading of the top rollers and the tensioning of the resilient elements, for example, compression springs, are effected simultaneously. Advantageously, a 4-over-3 drawing system is present, the top roller nearest the output—viewed in the direction of travel of the textile fibre material—is relieved of loading. Advantageously, the top roller is a deflecting roller. Advantageously, at least one top output roller is lifted away from the bottom output roller. Advantageously, a spacing is present between the top output roller and/or the top output rollers and the fibre slivers. Advantageously, upon machine standstill at least one top roller is capable of being bought automatically out of contact with the fibres. Advantageously, the last top roller in the material running direction is capable of being brought automatically out of contact with the fibres. Advantageously, upon re-start of the machine the previously lifted roller is capable of being returned automatically into engagement under pressure loading. Advantageously, a mechanical element is provided as resilient element. Advantageously, adjustment devices, for example, threaded pins or the like, are provided for adjustment of the position of the driver element.

The invention also provides a draw frame for textile fibre slivers, having a drawing system comprising a roller to which in use a load can be applied, the load being relievable when the draw frame is not in operation, the draw frame further comprising a lifting arrangement for lifting said roller away from a second roller with which it is in co-operation during operation of the draw frame, when the load is relieved.

Moreover, the invention provides apparatus on a draw frame for textile fibre slivers with loading of the top rollers of the drawing system of successively arranged pairs of rollers comprising a bottom and a top roller, in which, during operation, the top rollers are pressed against the bottom rollers by weighted pressing elements in pressing arms, wherein the bearings of the top rollers, at standstill, are relieved of the loading by the pressing arms and the top output roller or the top output rollers is/are capable of being relieved of pressure on interruption to continuous operation so that no or only slight pressure is exerted on the fibre slivers, wherein respective resiliently loaded elements are associated with the bearings of at least one top roller and lift the top roller bearings when the pressing elements are relieved of loading.

BRIEF DESCRIPTION OF THE DRAWINGS

FIG. 1 is a schematic side view of the drawing system of a draw frame with an arrangement according to the invention;

FIG. 2 shows part of FIG. 1 in the section corresponding to K-K (FIG. 1) with a pneumatic top roller loading device;

FIG. 3 is a front view of a pressing arm with integral housing and two rams, FIG. 3*a* is a perspective view of pressing arm shown in FIG. 3;

DESCRIPTION OF PREFERRED EMBODIMENTS

Figure 4A:
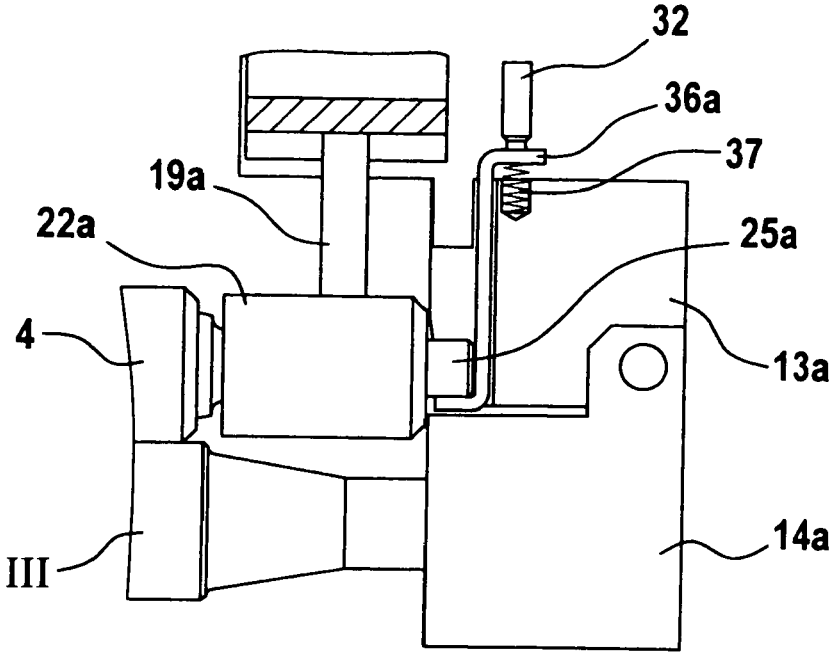
FIG. 4*a* is a front view, partly in section, of a top roller bearing loaded by a ram on one side and a bearing stub loaded by a tensioned spring, top and bottom roller being located one on top of the other with no gap between them.

With reference to FIG. 1, a drawing system S of a draw frame, for example, an HSR (Trade Mark) draw frame made by Trütrutzschler GmbH & Co. KG of Mömonchengladbach, Germany, is provided. The drawing system S is designed as a 4-over-3 drawing system, that is, it comprises three bottom rollers I, II, III (I being the bottom output roller, II the middle bottom roller, III the bottom intake roller) and four top rollers 1, 2, 3, 4. Drafting of the composite sliver 5 from a plurality of fibre slivers takes place in the drawing system S. The draft is made up from the preliminary draft and the main draft, and the roller pairs 4/III and 3/II form the preliminary drafting zone and the roller pairs 3/II and 1, 2/I form the main drafting zone. The bottom output roller I is driven by the main motor (not shown) and hence determines the rate of delivery. The bottom intake and middle bottom rollers III and II respectively are driven by a variable speed motor (not shown). The top rollers 1 to 4 are pressed against the bottom rollers I, II, III by pressing elements $\mathbf{9}_1$ to $\mathbf{9}_4$ (weighting device) in pressing arms 11*a* to 11*d* pivotable about pivot bearings (for example, as shown in FIGS. 3 and 4*a*), and are hence driven by way of frictional engagement. The direction of rotation of the rollers I, II, III; 1, 2, 3, 4 is indicated by curved arrows. The composite fibre sliver 5, which consists of a plurality of fibre slivers, runs in direction A. The bottom rollers I, II, III are mounted in bearers 14 (see FIG. 3) which are arranged on the machine frame 15.

Referring to FIG. 2, an upper supporting element 12 and a lower holding element 13*a* are associated with the pneumatic cylinder 9. The pneumatic cylinder 9 forms a cylinder unit having a cylinder cavity 17 comprising two parts 17*a* and 17*b*, in which a piston 18 is guided by means of a ram 19 in a sliding bushing 20. The roller journal 4*a* of the pressure roller 4 passes right through an opening in a holding plate 27*a* and engages in a bearing 22*a*. The bearing 22*a* receiving the pressure roller 4 extends into a space between the ram 19 and the roller journal IIIa of the bottom roller III. The bearing 22*a* is mounted on the holding element 13*a*. A diaphragm 16 divides the cylinder cavity 17 into pressure regions. In order to generate pressure in the upper part 17*a* of the cylinder cavity 17, compressed air $p_1$ can be admitted to this space by means of a compressed air connection 23. Air is evacuated from the lower part 17*b* of the cylinder cavity 17 through a vent bore 24. Analogously, air can be evacuated from the upper part of the cylinder cavity 17 and compressed air can be admitted to the lower part of the cylinder cavity 17. In operation, after a fibre sliver 5 has been guided over the bottom rollers I, II, III, the pressing arms 11 are pivoted into the working position shown in FIG. 4*a* and fixed in this position by a fixing device (not shown), so that the pressure rollers I, II, III are able to exert pressure. Application of pressure occurs on the one hand as a consequence of each of the rams 19 being located on the corresponding bearing 22, and on the other hand in that an overpressure is generated in the void above the diaphragm 16. The ram 19 therefore presses with its other end on the bearing 22, in order to generate the said clamping between the top roller 4 and the bottom roller (drive roller) III. The ram 19 is displaceable in the direction of the arrows D, E.

Referring to FIGS. 3, 3*a*, the top roller 4 has associated with it a portal-form pressing arm 11*a*. (A corresponding pressing arm 11*b*, 11*c*, 11*d* (not shown) is associated with each of the top rollers 2 to 4). In the embodiment shown in FIG. 3, the pressing arm 11*a* is in the form of a housing 11 of glass fibre-reinforced plastics and is manufactured by injection moulding. The housing 11 has an inner housing 30 which is an integral component of uniform construction comprising the supporting element 12, the two bodies of the pressing elements $9a_1$ and $9a_2$ (pressure cylinders), two intermediate elements 31*a* and 31*b*, and two holding elements 13*a* and 13*b*. The supporting element 12 is in the form of a channel 12*a* of approximately U-shaped cross-section open on one side, pneumatic lines 34 and electrical leads 35 being arranged in the interior of the channel. The open side of the channel 12*a* is closable by a removable cover 36, which consists of glass fibre-reinforced plastics material, has an approximately U-shaped cross-section and is resilient, such that it is fixed by an interference fit on the channel 33. The housing 30 is preferably of one-piece construction. The integral housing 30, which combines all the essential function elements for mounting and weighting the respective top rollers 1 to 4, can thus be manufactured economically. At the same time, in a simple manner the entire pressing arm 11*a* to 11*d* is rotatable about the centre of rotation 10 and can be locked and unlocked by a locking device 26 (for example, as shown in FIG. 5*a*). The rams 19*a* and 19*b* are relieved of pressure and hence lifted a distance $b_1$, $b_2$ from the bearings 22*a* to 22*b* of the top roller 4 (see FIGS. 4*b*, 5*b*).

In the embodiment of FIG. 4*a*, on one side of the top roller 4 the top roller bearing 22*a* is pneumatically loaded by the ram 19*a*. The top roller 4 and the bottom roller III are located one on top of the other with no gap between them. An angle lever 36*a* having two angle arms $36a^I$ and $36a^{II}$ projecting at right angles, one at each end, is mounted on the holding element 13*a* as driver element. As FIG. 4*c* illustrates, the angle arm $36a^I$ engages beneath the bearing stub 25*a* of the bearing 22*a*. The other angle arm $36a^{II}$ is resiliently biased by a compression spring 37, which is supported on the holding element 13*a*. The line of action 38 of the compression spring 37 and the line of action 39 of the ram 19*a* are parallel with one another. The angle lever 36*a* is mounted so that it is displaceable relative to the holding element 13*a* in the direction of the arrows F, G, whereby the position of the angle lever 36*a* is adjustable (when the pressing arm 11*a* is without pressure).

Figure 5A:
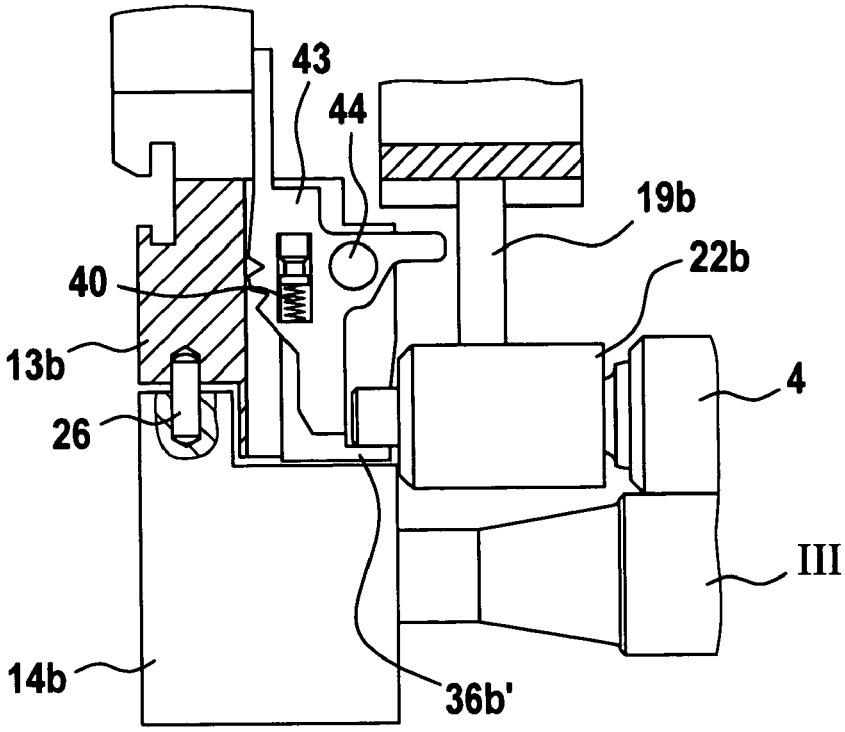
FIG. 5*a* is a front view, partly in section, of a top roller bearing of the top roller of FIGS. 4*a* to 4*c*, loaded by a ram and a bearing stub loaded with a tensioned spring, top and bottom roller (as in FIG. 4*a*) being located one on top of the other.

According to FIG. 5*a*, on the other side of the top roller 4, the top roller bearing 22*b* is pneumatically loaded by the ram 19*b*. An angled plate 36*b* (see FIG. 5*b*) is arranged as driver element on the holding element 13*b*; at one end of the angled plate an angle arm $36b^I$ projects at right angles. As FIG. 5*c* shows, the angle arm $36b^I$ engages beneath the bearing stub 25*b* of the bearing 22*b*. The angled plate 36*b* is resiliently biased by a compression spring 40, which is supported on the holding element 13*b*. The line of action 41 of the compression spring 40 and the line of action 42 of the ram 19*b* are axially parallel with one another. The angled plate 36*b* is mounted so that it is displaceable relative to the holding element 13*b* in the direction of the arrows F, G. The reference numeral 43 denotes a latching and unlatching element for the top roller 4, pivotally mounted around a pivot bearing 44. A threaded pin 45 acts on the angled plate 36*b*, whereby the position of the angled plate 36*b* (when the pressing arm 11*a* is without pressure) is adjustable.

In operation, corresponding to FIGS. 4*a*, 5*a*, the rams 19*a* and 19*b* load the top roller bearings 22*a* respectively 22*b* in direction D. In this way, the bearing stubs 25*a* and 25*b* mounted on the top roller bearings 22*a*, 22*b* respectively are also pressed downwards in direction M. Via the angle arm $36a^I$ and via the angle arm $36b^I$, the angle lever 36*a* and the angled plate 36*b*, and the bearing stubs 25*a* and 25*b*, are pulled downwards in direction F—against the force of the respective compression springs 37 and 40. At the same time and automatically, the compression springs 37 and 40 are consequently tensioned in direction N.

Figure 4B:
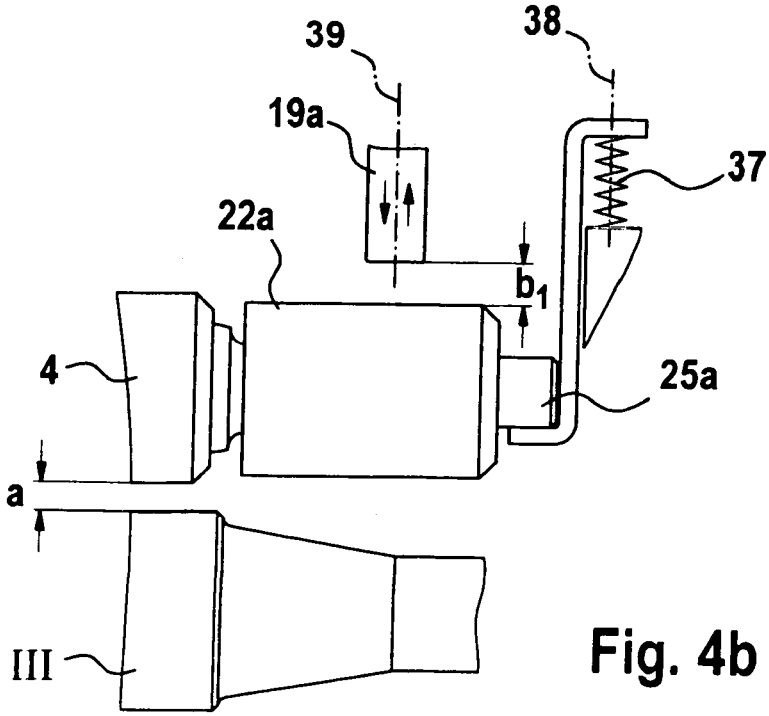
FIG. 4*b* shows a the top roller bearing of FIG. 4*a* relieved of loading by the ram and the bearing stub lofted with the relaxed spring, top roller and bottom roller having a gap between them.
Figure 4C:
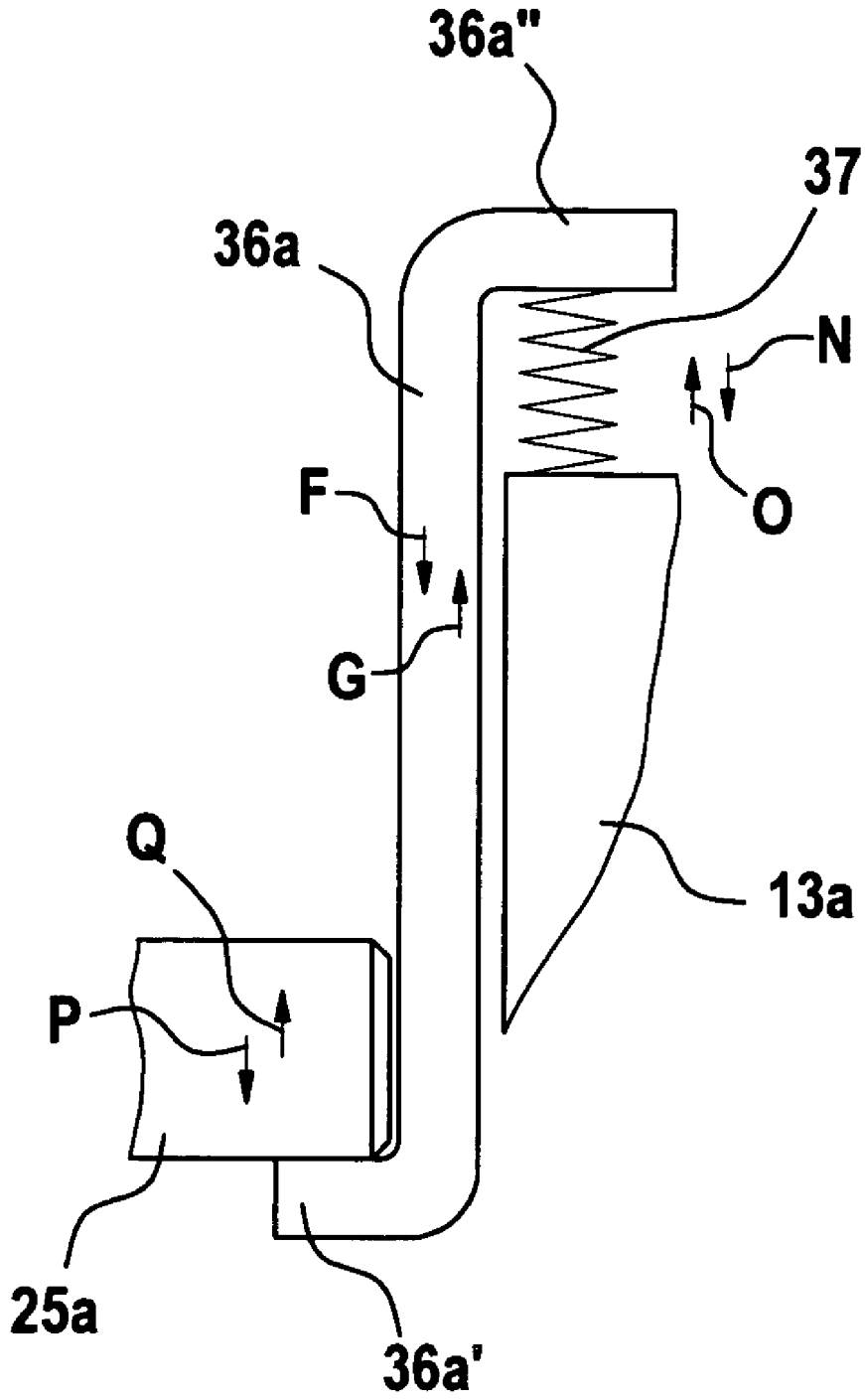
FIG. 4*c* shows in detail the spring-loaded angle lever shown in FIGS. 4*a* and 4*b;*
Figure 5B:
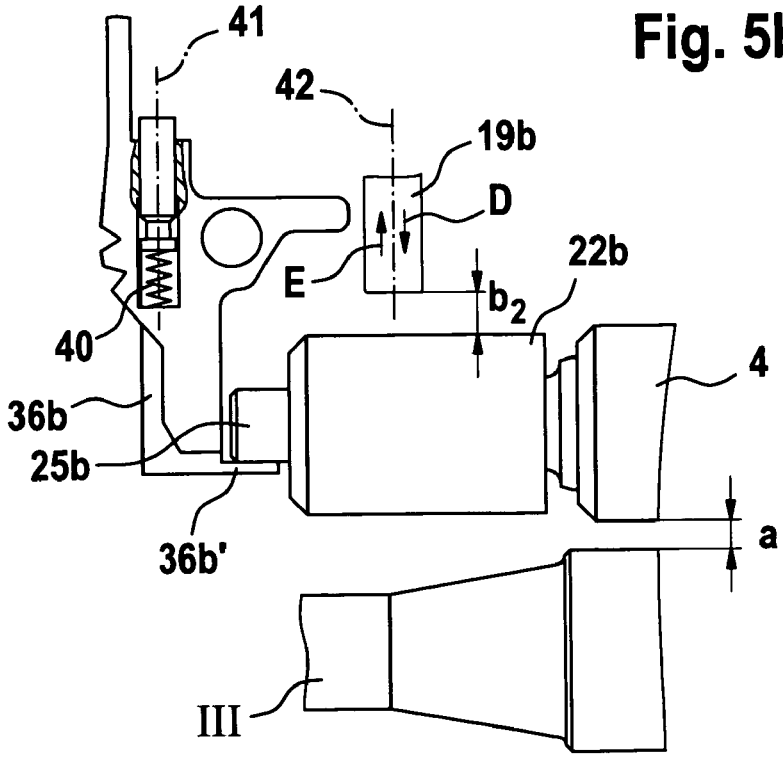
FIG. 5*b* shows the top roller bearing relieved of loading by the ram and the bearing stub lifted with the relaxed spring, top roller and bottom roller (as in FIG. 4*b*) having a gap between them.
Figure 5C:
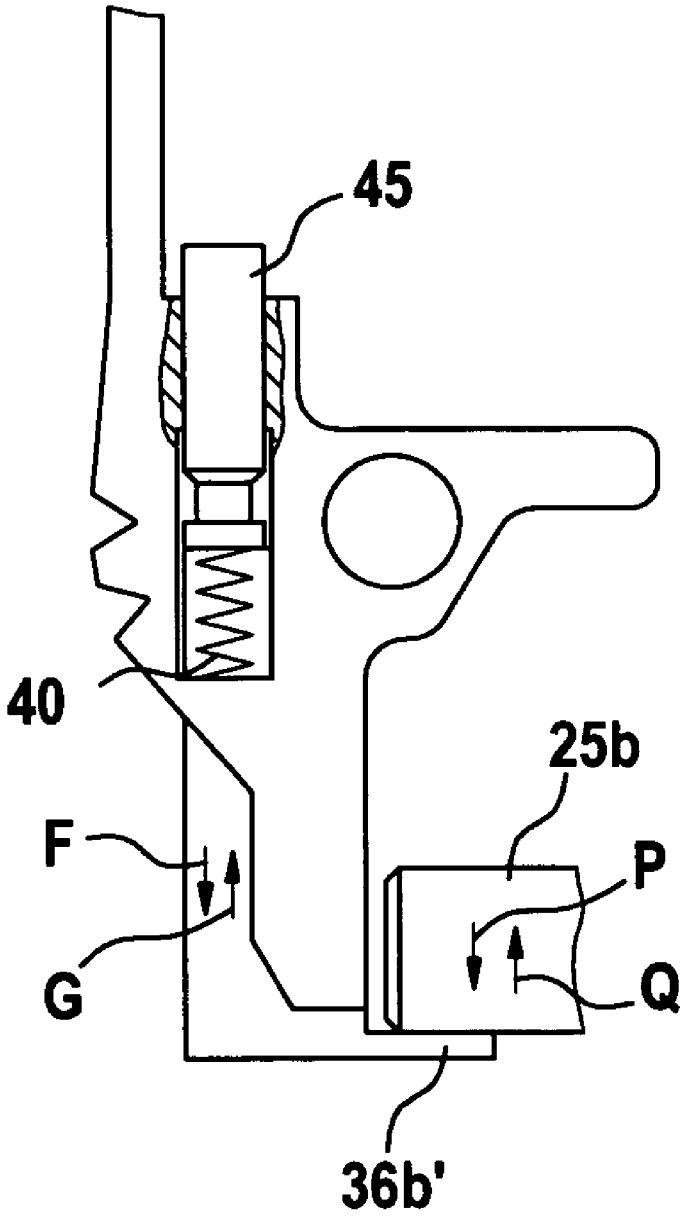
FIG. 5*c* shows in detail the spring-loaded angle lever shown in FIGS. 5*a* and 5*b;*

When operation is suspended, corresponding to FIGS. 4*b*, 5*b*, and the rams 19*a* and 19*b* are now relieved of loading in direction E, a gap $b_1$ respectively $b_2$ is present between the end of the rams 19*a* and 19*b* and the top roller bearings 22*a*, 22*b* respectively. Because the top roller bearings 22*a* and 22*b* have been relieved of loading, and by virtue of the gaps $b_1$ and $b_2$, the bearing stubs 25*a* and 25*b* are likewise relieved of loading in direction L. Owing to the relaxation of the compression springs 37 and 40, the bearing stubs 25*a* and 25*b* are pulled upwards or lifted in direction G by way of the angle lever 36*a* and the angled plate 36*b*, by means of the angle arm $36a^I$ and the angle arm $36b^I$ respectively. At the same time and automatically, the compression springs 37 and 40 consequently relax in direction O.

Figure 6A:
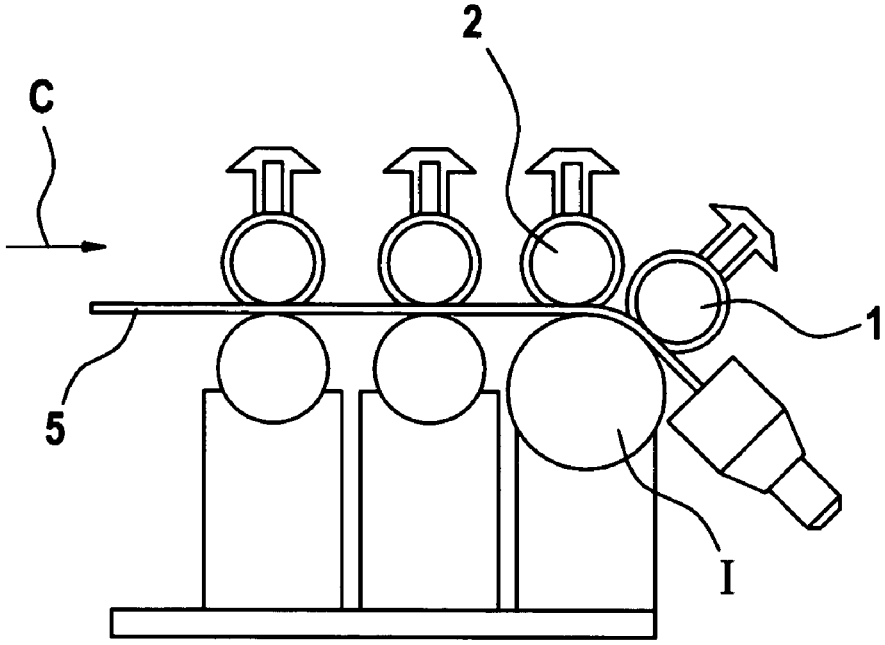
FIG. 6*a* shows a drawing system of a draw frame according to the invention in operation with the top rollers loaded.
Figure 6B:
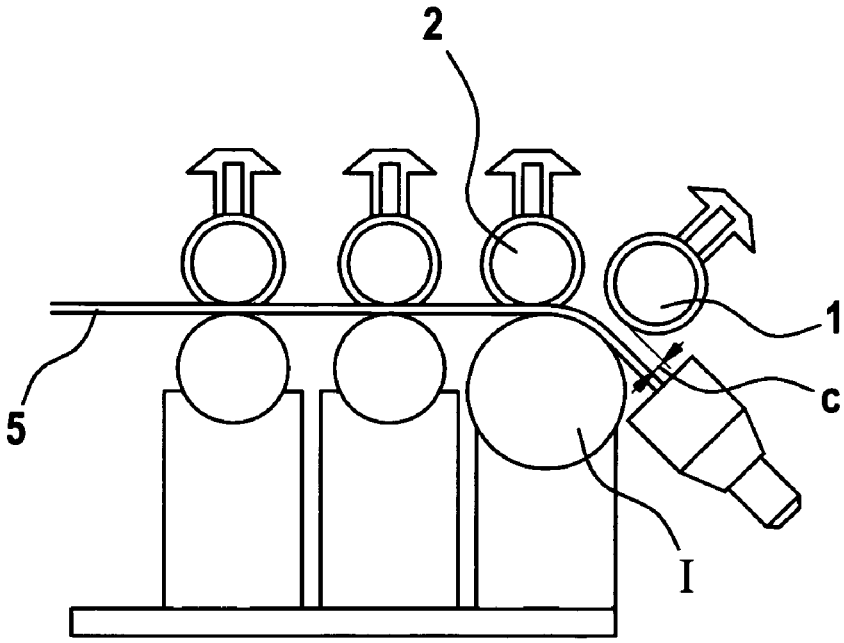
FIG. 6*b* shows the drawing system of FIG. 6*a* when operation is suspended, with the top rollers relieved of load and with the top output roller (deflecting roller) lifted.

Referring to FIG. 6*a*, in operation the top output rollers 1 and 2 lie on the bottom output roller I with applied loading, the fibre material 5 running through between the top output rollers 1 and 2 and the bottom output roller I. Upon extended stoppage time—which is detected in the electronics control and regulating device, not shown, for the drive motors—the top output roller 1 is relieved of loading and immediately thereafter, as shown in FIG. 6*b*, lifted by the distance c away from the fibre material 5 and the bottom output roller I. This prevents the fibre material 5 from adhering via foreign bodies and so on, as a result of pressure, to the top output roller 1. Because the top output roller 2 is now relieved of loading and hence remains in place by gravity, the fibre material 5 remains firmly clamped and held between the top output roller 2 and the bottom output roller I and, upon re-start, can be guided without problem by the top output roller 1 and the bottom output roller I.

Except where the opposite is apparent, the same reference numerals are used to indicate corresponding parts in each of the drawings The invention has been described by the example of pneumatic pressing elements (loading elements). Alternatively, mechanical, hydraulic or electrical pressing elements for loading the top rollers 1 to 4 can be used.

In practice, many loops appear around the deflecting roller 1, usually caused by lubricating agents and adhesive particles present on the fibres. After an operational disturbance in the machine (sliver rupture, coiler can change or the like), the machine attendants are often not able to resolve such incidents immediately. The draw frame relieves the drawing system of loading after an interruption occurs, but the hot deflecting roller 1 lies on the fibres 5 under its own weight. If the deflecting roller 1 lies for an extended period on the sticky fibres 5, these adhere to the deflecting roller 1 and upon restart, the sticky fibres 5 wrap themselves around the deflecting roller 1. The measures according to the invention enable the deflecting roller 1 to be lifted by means of a resiliently loaded driver element 36*a*, 36*b*. By lifting the deflecting roller 1, the fibres 5 can no longer stick to the roller, and the pressure on the lower roller 1 is reduced, whereby the wrap-round tendency is considerably reduced. The reduction in the wrap-round tendency significantly increases the efficiency of the draw frame when sticky fibres are being processed, because operational disturbances and their elimination are reduced or avoided Although the foregoing invention has been described in detail by way of illustration and example for purposes of understanding, it will be obvious that changes and modifications may be practised within the scope of the appended claims.

What is claimed is:

1. A draw frame for textile fibre slivers having a drawing system comprising:

a first roller assembly and a second roller assembly, said first and second roller assemblies being arranged one after the other and each comprising a bottom roller and a top roller having first and second top roller bearings;

a loading arrangement for applying a load to said top rollers so as to press said top rollers against said respective bottom rollers, which load can be substantially relieved by the loading arrangement; and a lifting arrangement for lifting a said top roller from a said bottom roller when said load is substantially relieved, wherein the lifting arrangement is actuated automatically in response to operation of the loading arrangement to relieve the load.

2. A draw frame according to claim 1, in which the lifting arrangement comprises:

a first resiliently loaded element associated with a first top roller bearing of a said top roller;

a second resiliently loaded element associated with a second top roller bearing of that roller;

said first and second resiliently loaded elements being arranged for lifting said first and second top roller bearings when the load applied by the loading arrangement is substantially relieved.

3. A draw frame according to claim 2, further comprising first and second resilient loading elements for loading said first and second resiliently loaded elements.

4. A draw frame according to claim 3, in which at least one of said first and second resilient loading elements is a spring.

5. A draw frame according to claim 3, in which at least one said resiliently loaded element is a driver element.

6. A draw frame according to claim 5, wherein the driver element comprises an angle member having an angle arm that engages beneath one of the first or second top roller bearings.

7. A draw frame according to claim 3, wherein at least one of said resilient loading elements is supported on a fixed bearing.

8. A draw frame according to claim 3, wherein the resilient loading elements are arranged to act along a line of action that is substantially parallel to a line of action of the loading arrangement.

9. A draw frame according to claim 3, wherein the resilient loading elements are resiliently deformed during operation of the draw frame.

10. A draw frame according to claim 9, wherein the resilient loading elements are arranged to relax when the loading arrangement is actuated to relieve the top roller of loading.

11. A draw frame according to claim 1, wherein the roller assemblies form part of a 4-over-3 drawing system and the loading and lifting arrangements are arranged to act on a top roller nearest an output of the draw frame.

12. A draw frame according to claim 1, wherein the loading arrangement and/or the lifting arrangement are arranged to act on a top roller that is a deflecting roller.

13. A draw frame according to claim 1, wherein the loading arrangement is operable to relieve load on a roller of a roller assembly having three rollers.

14. A draw frame according to claim 1, wherein a last top roller in a direction of travel of the fibre slivers is capable of being brought automatically out of contact with the fibres.

15. A draw frame according to claim 1, wherein upon re-start of the draw frame, a previously lifted top roller is capable of being returned automatically into engagement with the respective bottom roller under pressure loading.

16. A draw frame according to claim 5, further comprising at least one adjustment device arranged to adjust a position of the driver element of the lifting arrangement when the load on said top rollers is substantially relieved.

17. A draw frame for textile fibre slivers, having a drawing system comprising:

a roller to which in use a load can be applied, the load being relievable when the draw frame is not in operation; and a lifting arrangement for automatically lifting said roller away from the second roller with which it is in co-operation during operation of the draw frame, when the load is relieved.

18. An apparatus on a draw frame for textile fibre slivers, comprising: a drawing system including:

a plurality of pressing arms each having weighted pressing elements;

a plurality of successively arranged pairs of rollers, each pair of rollers being associated with a respective pressing arm and comprising:

a bottom roller having bottom roller bearings; and a top roller having top roller bearings; and at least one resiliently loaded element associated with the top roller bearings of at least one pair of rollers, wherein, during operation of the apparatus, the top rollers are arranged to press against the bottom rollers and the fiber slivers therebetween by the weighted pressing elements in the pressing arms, and wherein, upon interruption of operation of the apparatus, the weighted pressing elements are arranged to relieve the pressing load on the top rollers so that no or only slight pressure is exerted on the fibre slivers and the at least one resiliently loaded element is arranged to lift the respective top roller in a direction away from the respective bottom roller.

19. A draw frame according to claim 1, wherein the loading arrangement is a pneumatically operated loading arrangement.

20. A draw frame according to claim 1, wherein the lifting arrangement is a mechanical lifting arrangement.

21. A draw frame according to claim 17, further comprising a pneumatically operated loading arrangement.

22. A draw frame according to claim 17, wherein the lifting arrangement is a mechanical lifting arrangement.

* * * * *